US006223734B1

(12) United States Patent
Ruoff et al.

(10) Patent No.: US 6,223,734 B1
(45) Date of Patent: May 1, 2001

(54) FUEL INJECTION SYSTEM FOR AN INTERNAL COMBUSTION ENGINE

(75) Inventors: Manfred Ruoff, Moeglingen; Horst Harndorf, Schwieberdingen, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/331,486

(22) PCT Filed: Jul. 6, 1999

(86) PCT No.: PCT/DE98/01864

§ 371 Date: Aug. 2, 1999

§ 102(e) Date: Aug. 2, 1999

(87) PCT Pub. No.: WO99/20891

PCT Pub. Date: Apr. 29, 1999

(30) Foreign Application Priority Data

Oct. 22, 1997 (DE) ..... 197 46 490

(51) Int. Cl.[7] ..... F02B 47/02
(52) U.S. Cl. ..... 123/575
(58) Field of Search ..... 123/25 C, 575, 123/467, 576, 577, 578

(56) References Cited

U.S. PATENT DOCUMENTS 4,520,774 * 6/1985 Sitter ..... 123/575
4,524,033 * 6/1985 Elledge ..... 123/575
4,590,904 * 5/1986 Wannenwetsch ..... 123/575
4,612,905 * 9/1986 Dietrich ..... 123/575
4,693,227 * 9/1987 Satou ..... 123/575
4,705,010 * 11/1987 Baranescu ..... 123/575
5,174,247 * 12/1992 Tosa ..... 123/575
5,732,679 * 3/1998 Takahashi ..... 123/467
5,862,793 * 1/1999 Jay ..... 123/467
5,979,410 * 11/1999 Grieshaber ..... 123/467
6,067,964 * 5/2000 Ruoff et al. ..... 123/585

* cited by examiner

*Primary Examiner*—Marguerite McMahon
*Assistant Examiner*—Jason Benton
(74) *Attorney, Agent, or Firm*—Ronald E. Greigg; Edwin E. Greigg

(57) ABSTRACT

A fuel injection system comprising a common rail pressure reservoir filled with fuel at high pressure and having a dual-substance nozzle for dual fluid injection of fuel and a supplementary liquid into an internal combustion engine. The system includes a first 2/2-way valve, in the injection line between the common rail pressure reservoir and a pressure chamber surrounding the nozzle needle of the dual-substance nozzle, and a second 2/2-way valve, whose inlet communicates, via a feed line with the injection line at a point between the first 2/2-way valve and the pressure chamber. An outlet of the pressure chamber communicates with the low-pressure fuel side via a drain line (8). As a result, the otherwise usual, technologically much more complicated 3/2-way magnet valves can be replaced with more economical 2/2-way valves. At the same time, the possibility is afforded of shifting the quantity metering for supplementary liquid to a single metering valve that serves an entire group of fuel injectors.

19 Claims, 2 Drawing Sheets

FUEL INJECTION SYSTEM FOR AN INTERNAL COMBUSTION ENGINE

PRIOR ART

The invention is based on a fuel injection system for an internal combustion engine.

Such fuel injection systems are known for instance from German patent DE 43 37 048 C2. In it, on the one hand a dual substance nozzle is provided that serves the purpose of laminated injection of fuel and a supplementary liquid, such as diesel fuel and water, so as to reduce pollutant emissions from the engine and possibly to increase its efficiency. On the other hand, in the known injection system, the so-called common rail technique is employed, in which all the injection nozzles serving the engine are charged with fuel at high pressure from a common rail pressure reservoir.

It is disadvantageous in the known fuel injection system that one complicated and relatively expensive 3/2-way valve is needed for each individual injector for metering the quantity of supplementary liquid, as well as one further 3/2-way valve for controlling the diesel injection quantity. For prestorage of the supplementary liquid, the fuel delivery from the common rail pressure reservoir to the injection nozzle is disrupted using the first 3/2-way valve and at the same time a pressure chamber surrounding the md and in which fuel at high pressure is stored is drained off to the low-pressure fuel side by means of a suitable position of the first 3/2-way valve. By means of the resultant pressure drop in the pressure chamber, supplementary liquid is fed via a suitable line into the pressure chamber and positively displaces the equivalent volume of fuel. Next, the first 3/2-way valve is returned to a position that establishes a communication between the common rail pressure reservoir and the pressure chamber in the injection valve. For quantitatively precise metering of the fuel quantity to be injected and that is intended to follow the prestored supplementary liquid in the injection surge caused by the next valve opening, the further 3/2-way magnet valve is provided, which selectively connects the back end of the nozzle needle, which is held in the closing position by a spring, selectively with either the common rail pressure reservoir or the low-pressure fuel side and as a result chronologically controls the valve needle stroke, the opening and closing of the valve, and thus the desired injection quantity.

In principle, the known fuel injection system for each individual injector requires the two precise and thus complicated 3/2-way control magnet valves, so that both the desired fuel quantity and the required quantity of supplementary liquid can be metered exactly.

ADVANTAGES OF THE INVENTION

The fuel injection system according to the invention, to simplify its structure and thus make it more economical to produce, will be set forth herein after. As a result, the two complicated and expensive 3/2-way magnet control valves can be replaced with a single, simpler and less expensive 2/2-way valve, and at the same time the possibility is afforded of shifting the quantitative metering for the supplementary liquid to a single, precision metering valve, which can serve an entire group of injectors. While the second 2/2-way valve determines solely the opening and closing time for the supplementary liquid prestorage, the quantitative metering for the fuel quantity to be injected is effected by means of a suitable timing control of the second 2/2-way valve in the injection line between the common rail pressure reservoir and the pressure chamber.

In order to assure constant pressure conditions in the line system, and especially to prevent outgassing of the supplementary liquid, as a rule water, at high temperatures if the boiling point is exceeded, it is recommended that a check valve be used between the second 2/2-way valve and the low-pressure fuel side.

It is also advantageous if the nozzle needle on the butt end of its injector tappet, in a radial extension, has a small piston which protrudes into a chamber acted up by high pressure from the common rail pressure reservoir; this chamber is in turn sealed off in pressure proof fashion from the chamber surrounding the nozzle needle. By subjecting the constant piston area to the common rail pressure, the control motions of the nozzle needle in the injection event become independent of the absolute pressure conditions in the common rail pressure reservoir, because for the motion of the injector tappet, it is always the same resistance, namely the force of the valve spring, that needs to be overcome, and thus The motion forces remain constant. The result is constant switching times, which are favorable from a control standpoint and are each determined by the applicable time of motion of the injector tappet.

An embodiment of the fuel injection system according to the invention in which the high-pressure pump for pumping the fuel is part of a high-pressure pump unit that can accomplish the quantitative metering for both the fuel injection and the injection of supplementary liquid is especially preferred. In this way, on the one hand, the M pump usually used for metering the supplementary liquid can be dispensed with, and on the other the overall system can be designed more compactly. The high-pressure pump unit, which as before supplies the common rail pressure reservoir, now via a further hydraulic line also drives a divider piston unit, with which the volumetric quantity of supplementary liquid specified by the high-pressure pump unit is dispensed into the dual-substance nozzle.

To that end, in a special feature, the high-pressure pump unit of the invention has one or more high-pressure pistons, which counter-to the pressure of compression springs compress fuel in a compression chamber to a pressure level of over 1000 bar, and as a rule even to nearly 2000 bar. The high-pressure pistons are preferably disposed in line and are driven by a camshaft. On one end of the compression chamber outside the path of reciprocation of the high-pressure pistons, a longitudinally movable gap-sealed first piston is disposed, which is braced by a compression spring against a likewise longitudinally movable gap-sealed second piston. The backside face of the second piston is rounded or beveled, so that a longitudinally displaceable dimensioning wedge can rest on it in force-locking fashion and can longitudinally arrest the second piston in a-variable relative axial position with respect to the first piston. To adjust the relative position of the two pistons, a triggerable electric motor is preferably provided, which drives a spindle that engages a thread of the dimensioning wedge.

It is also possible according to the invention for the divider piston unit to have a special design, namely instead of a conventional divider piston a diaphragm, which is braced firmly in the divider piston unit and sealingly partitions off one inner chamber having fuel from the other inner chamber having supplementary liquid. As a result, the never entirely avoidable, albeit slight mixing, when conventional divider pistons are used, of the operating fluid of the divider piston with the fluid (in this case supplementary liquid) to be pumped is reliably avoided. To prevent the diaphragm from rupturing in the event of very forceful pressure deflections, a mechanical stop is preferably provided in the inner chamber of the divider piston unit charged with supplementary liquid, and the diaphragm can run up against this stop, which defines its maximal expansion.

Further advantages and advantageous features of the subject of the subject of the invention can be learned from the specification, drawing and claims.

BRIEF DESCRIPTION OF THE DRAWINGS

Two exemplary embodiments of the fuel injection system of the invention for internal combustion engines are shown in the drawings and will be described in the ensuing description.

Shown are.

DESCRIPTION OF THE EXEMPLARY EMBODIMENT

Figure 1:
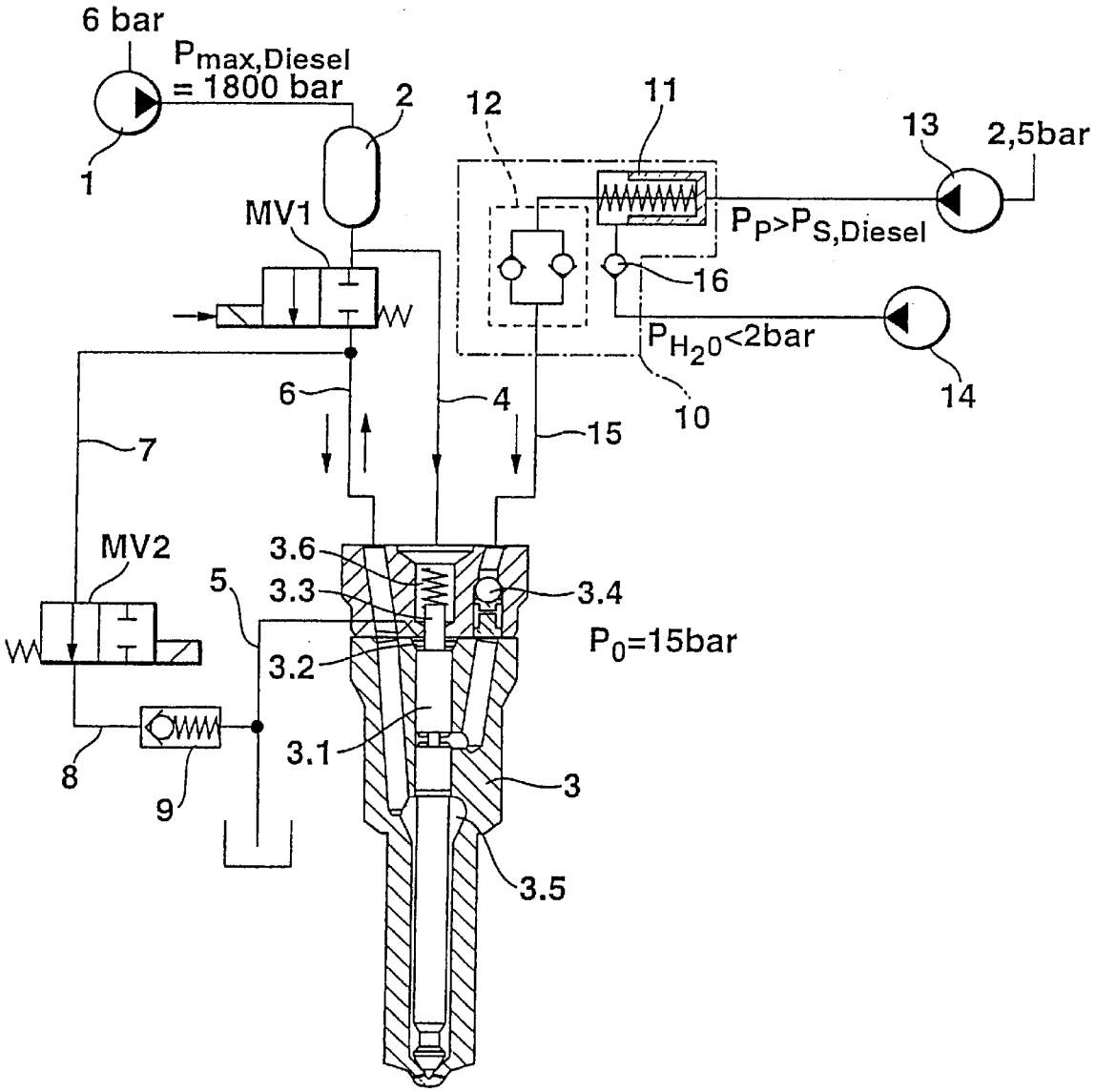
FIG. 1 illustrates, a schematic circuit diagram of a first exemplary embodiment of the fuel injection system of the invention, with two 2/2-way valves for controlling the pumping or injection quantity of fuel and supplementary liquid through a dual-substance nozzle shown schematically in longitudinal section, in which the supplementary liquid to the dual-substance nozzle is charged by a divider piston system with an equal-pressure valve assembly.

In the first exemplary embodiment, shown in FIG. 1, of the fuel injection system of the invention for an internal combustion engine for dual-fluid injection of fuel (as a rule, diesel fuel) and a supplementary liquid (as a rule, water), a high-pressure pump 1 supplies a common rail pressure reservoir 2 with fuel at a pressure level of approximately 1800 bar. Between the common rail pressure reservoir 2 and a pressure chamber 3.5, which surrounds the nozzle needle 3.1 of a dual substance nozzle 3 and is to be supplied with fuel from the common rail pressure reservoir via an injection line, a quantity metering component must now be disposed, since after all, the classical injection pump that was typical earlier has been replaced by the combination of a common rail pressure reservoir 2 and the simpler high- pressure pump 1, and the rail pressure is always available at a certain level. This task is taken over, in the arrangement of the invention, by a first 2/2-way valve MV1. This valve should be designed as a high-speed magnet valve with good replicability and a more or less fluid transition between its two extreme positions, since a chronologically configurable course of injection quantity may possibly be needed. The precise quantity metering is made possible by way of the known (measured or controlled) pressure drop between the common rail pressure reservoir 2 and the engine combustion chamber to be supplied by the dual substance nozzle 3, by means of a precise time slot, whose size depends on other factors, by way of an electrical triggering means that is not shown in the drawing.

Except for minor details, the design and mode of operation of the dual substance nozzle 3 used is known from the prior art. In the system of the invention, however, a small piston 3.3 is additionally provided on the axial butt end, remote from the tip, of the nozzle needle (injector tappet) 3.1; this piston protrudes with its end remote from the nozzle needle 3.1 into a chamber 3.6, which via a line 4 communicates directly with the common rail pressure reservoir 2 and is acted upon by the high pressure prevailing there. As a result, in order to move the injector tappet 3.1, essentially the same resistance force must always be overcome, since now because of the constant piston area ratios and the preclusion of the influence of the absolute pressure in the common rail pressure reservoir 2, only a constant spring pressure needs to be overcome by a pressure pulse from the (variable) rail pressure. As a result, virtually constant switching times (motion time of the injector tappet) ensue, which are much more convenient from the standpoint of control technology. For venting the chamber 3.2 that receives the axial butt end of the nozzle needle 3.1 and that is sealed off against high pressure from the chamber 3.6, a vent line 5 leading to the low-pressure fuel side is provided.

To introduce supplementary liquid, it is now necessary, as known per se in principle from the prior art, to clear away for the fuel, to be positively displaced by the supplementary liquid, out of the dual-substance nozzle 3. This is done by suitable connection of a second 2/2-way valve MV2, whose inlet communicates with the injection line 6 via a feed line 7 and whose outlet communicates via a low-pressure fuel side via a drain line 9. If supplementary liquid line is to be added in metered fashion, the first 2/2-way valve MV1 is closed, and the second 2/2-way valve is switched to the open position. As a result, fuel at high pressure escapes from the pressure chamber (3.5) to the low-pressure fuel side, as a rule the fuel tank, via the injection line 6, feed line 7, drain line 8, and a check valve 9. As a result, replenishing supplementary liquid can flow into the pressure chamber 3.5 from a supplementary liquid line 15, leading to the dual-substance nozzle 3, via a check valve 3.4 (where $p_0$32 15 bar) The fluid carrying bores of the dual-substance nozzle 3 and the line lengths, however, must be dimensioned in such a way and the lines attached in such a way that no supplementary liquid can get into the fuel tank.

Before the actual injection event for the supplementary liquid, the correct quantity of supplementary liquid must be metered and pumped, while the system pressure is still low, into the dual-substance nozzle 3. This is accomplished by means of a so-called M pump 13, which pumps an operating fluid at a pilot pressure of approximately 2.5 bar into a divider piston adapter 10 that has a divider piston 11 and an equal-pressure valve 12. The divider piston adapter 10 separates the operating fluid (as a rule, Diesel fuel) of the M pump 13 from the supplementary liquid (as a rule, water) to be introduced. In the process, the water side of a cylinder liner in the divider piston 11 is charged with supplementary liquid at low pressure (small p<2 bar) by a fill pump 14 via a check valve 16. At the correct time before the actual injection, that is, between the injection cycles, a desired quantity of operating fluid is dispensed by the M pump 13 to the divider piston 11 at a higher pressure than that for which the check valve 3.4 of the dual-substance nozzle 3 is set. As a result, the quantity of supplementary liquid, of which on the other side of the divider piston 11 corresponds to the quantity of operating fluid of the M pump 13, is sent onward via the equal-pressure valve 12 to the supplementary liquid line 15. The equal-pressure valve 12 serves to relieve the pressure or supply the correct pilot pressure to the supplementary liquid line 15 between the divider piston adapter 11 and the dual-substance nozzle 3.

The second 2/2-way valve MV2 can furthermore be a relatively simple and less-expensive valve than the first 2/2-way valve MV1, since the precision of the latter is not absolutely required for the function of positive fuel displacement out of the pressure chamber 3.5 for the sake of prestorage of supplementary liquid, and moreover only an unambiguous yes/no behavior of the valve MV2 is needed.

Figure 2:
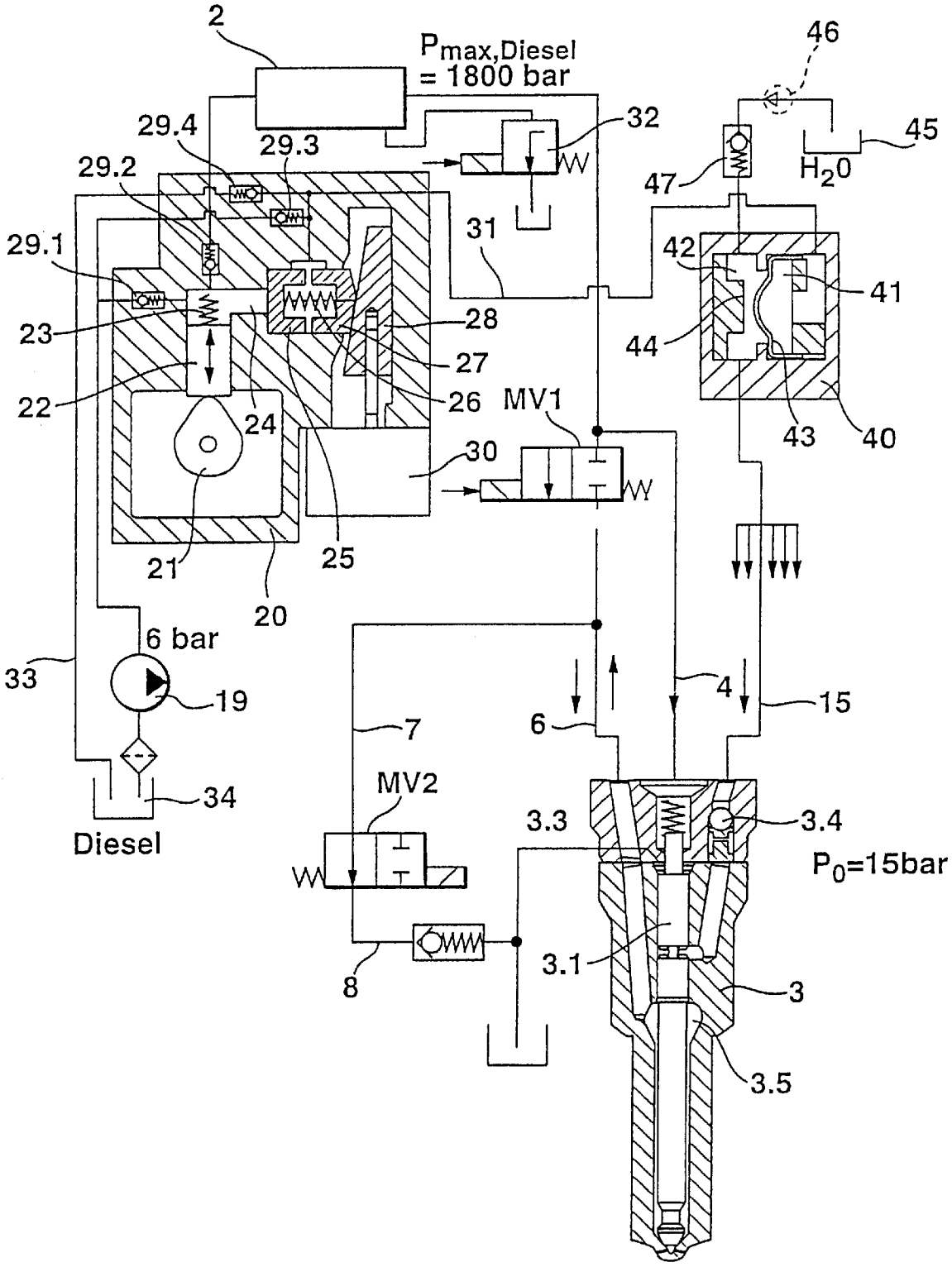
FIG. 2 illustrates, a second exemplary embodiment with a high-pressure pump unit for charging the common rail pressure reservoir and simultaneously metering the volume of supplementary liquid in a divider piston unit, which is equipped with a diaphragm.

The further exemplary embodiment, shown in FIG. 2, of the fuel injection system of the invention differs from the embodiment shown in FIG. 1 on the one hand in having a high-pressure pump unit 20 which not only charges the common rail pressure reservoir 2 but also takes on the task of volumetric metering for supplementary liquid, and on the other in having a modification of the divider piston unit 40, which now has a diaphragm 43 instead of a conventional divider piston.

The high-pressure pump unit 20 is charged by a fuel pump 19, which draws fuel from a fuel tank 34 and pumps it, at a pressure level of about 6 bar, via a check valve 29.1 into a compression chamber 24 of the high-pressure pump unit 20. A plurality of preferably in-line high-pressure pistons 22, driven by a camshaft 21 and each pressed back against the cam of the camshaft 21 by compression springs 23, during their respective stroke each effect a compression of the fuel in the pressure chamber 24. As a result, when a defined threshold pressure is exceeded, an outlet valve 29.2 integrated with the high-pressure pump unit 20 is opened, and fuel is pumped at a pressure level of about 1800 bar into the common rail pressure reservoir 2, whose internal pressure is kept constant, or is regulated to the desired level, via a pressure regulating valve 32.

In order now to be able, via a hydraulic line 31, to charge the divider piston unit 40 with a desired volume for a particular dual-substance nozzle 3, which volume is dispensed as a supplementary liquid volume, via the supplementary liquid line 15, the following arrangement is provided in the high-pressure pump unit 20: Laterally of the compression chamber 24, outside the range of reciprocation of the high- pressure pistons 22, a longitudinally movable, gap-sealed first piston 25 is disposed, which is braced apart from a second piston 27 by means of a compression spring 26. The second piston 27, on its backside face remote from the first piston 25, has a rounded or beveled tip on which a longitudinally displaceable dimensioning wedge 28 rests in force-locking fashion. By suitable displacement of the dimensioning wedge 28, the relative axial position of the second piston 27 with respect to the first piston 25 can therefore be varied. The drive of the dimensioning wedge 28 is effected via a spindle, which is driven by an electric motor 30 and engages a suitable thread in the dimensioning wedge 28 and displaces this wedge in its longitudinal direction upon rotation of the electric motor 30.

If one of the high-pressure pistons 22 now executes a compression stroke and subjects the fuel in the compression chamber 24 to pressure, the first piston 25 is displaced, counter to the force of the compression spring 26, in the direction of the second piston 27 which is longitudinally arrested at the backside by the dimensioning wedge 28. Given suitable dimensioning of the spring characteristics of the compression spring 26, the first piston 25 can in turn, during the high-pressure compression process by the corresponding high-pressure piston 22, perform expulsion work until such time as it strikes the second piston 27. As a result, a precisely defined fuel volume is sent onward, out of the chamber between the two pistons 25 and 27 that contains the compression spring 26, to the divider piston unit 40 via the hydraulic line 31. During an intake stroke, when the compression chamber 24 is increased in volume, the first piston 25 moves axially away from the second piston 27 again because of the force of the compression spring 26, and fuel can be dispensed by the fill pump 19 into the chamber between the two pistons 25 and 27 via an inlet check valve 29.3.

The volume of fuel sent on to the divider piston unit 40 by the high-pressure pump unit 20 via the hydraulic line 31 enters a first inner chamber 41 of the divider piston unit 40; this chamber is partitioned off in sealing fashion from a further inner chamber 42, which contains supplementary liquid, by means of the diaphragm 43 fastened in pressure proof fashion. Depending on the particular volumetric surge of fuel pumped, the diaphragm 43 expands, with precisely the same volumetric positive displacement, into the inner chamber 42, and as a result the appropriate quantity of supplementary liquid is transported onward via the supplementary liquid line 15 to one or more dual-substance nozzles 3, which are represented in FIG. 2 by parallel arrows.

If the geodetic gradient for pumping the supplementary liquid fails to be attained, then the supplementary liquid is pumped by a fail pump 46 out of a supplementary liquid container 45 via a check valve 47 into the inner chamber 42 of the divider piston unit 40.

Since the pressure for injecting supplementary liquid is substantially lower (approximately 20 to 30 bar) then the lowest pressure in the common rail pressure reservoir 2 (approximately 500 bar), mobility of the first piston 25 for the indirect metering of supplementary liquid during the compression phase of the high-pressure pistons 42 will be readily possible. The defined quantity of fuel for the quantitative metering of supplementary liquid is specified fairly precisely by the position, and the thus-presented stop of the pistons 25 and 27, of the dimensioning wedge 28, which in turn can be adjusted by the threaded spindle of the electric motor 30. The electric motor 30 receives its control command from an engine management system, not shown in the drawing. Since the quantitative expulsion of Diesel fuel for metering the quantity of water takes place during the high-compression phase of the high-pressure pistons 22 rather than at the correct instant for water injection, the second 2/2-way valve MV2 of the correct injector 3 for water prestorage must be connected at the correct instant in order to release the quantity of Diesel fuel, to be positively displaced by the water quantity, in the injector 3.

If a defined, temporarily unchanged control position of the dimensioning wedge 28 is made a precondition, and if the first piston 25 is made to perform its expulsion work and its intake events, then something like a closed hydraulic system exists in cooperation with the yielding diaphragm 43 of the divider piston unit 40 in the chambers designated as the "diaphragm-Diesel side", "line 31" and in the "compression chamber of the pistons 25 and 27"; in other words, at all times it is only Diesel fuel that is shifted back and forth. The system is replenished by the Diesel fill pump 19 only whenever intake defects may occur, for instance from leakage from the pistons 25 and 27. If the dimensioning wedge 28 is now pulled downward, that is, in the direction of greater volumetric surges, then an intake defect again exists. The first piston 25 receives the missing amount from the Diesel fuel pump 19. The intended consequence is that the diaphragm 43 is naturally deflected farther per stroke than before.

In the "closed hydraulic system", however, there is now more volume available than in the previous position of the dimensioning wedge 28. If in the context of power adaptation, which takes precedence, the dimensioning wedge 28 is moved backward again by a considerable distance, then by that time there may be so much volume in the system that the diaphragm 43 no longer returns to its "zero position", yet still continues to perform its set strokes, but they are now shorter. In other words, some diaphragm drift is now present. If there is frequent adjustment, as will often be the case, this drift can be so extensive that there is a risk of an overload of the diaphragm 43. To prevent this in such cases, the diaphragm 43 should strike against a stop 44 in the inner chamber 42.

An overpressure will briefly build up in the system, and the volume that causes it is diverted to the fuel tank 34 via an outlet check valve 29.4, which is preferably integrated with the high-pressure pump unit 20, and via a relief line. This result is merely a brief miscontrol of water quantity (too little may be injected—not a total failure!), which will hardly have any dramatic effect in terms of the avoidance of nitrogen oxide during the many other properly regulated combustion events.

If water injection is not needed, then furthermore by means of the electric motor 30, or the dimensioning wedge 28 moved by it, the water quantity can be reduced to zero. The pistons 25 and 27 are then simply pressed together more or less, so that the first piston 25 can no longer execute any working stroke.

To assure proper, unimpeded operation of the injectors 3 with the appropriate quantity of water, it would seem necessary at first glance to install one high-pressure piston 23, with pistons 25 and 27 attached to it, and one divider piston unit 40, for each injector 3.

For typical utility vehicle Diesel engines with many working cylinders, however, this would be very expensive and moreover would take up considerable installation space. Such costs and space requirements can be reduced by having entire groups of injectors or all the injectors supplied by only a few water supply tracts.

If the layout is arranged this way, then care must be taken to prevent the pistons 25 from pumping in recirculation. That is, a piston 25 must be prevented from aspirating just while another piston 25 is sending an amount of Diesel fuel to the divider piston unit 40. This condition must be organized with regard to the course over time of the working strokes. In the planning process, the possible reduction in, or the absolutely required number of, high- pressure pistons 22 and their structural relationship for supplying the water quantity will arise out of the above considerations, as long as no other arguments, involving pressure pulsations in the common rail pressure reservoir, etc., stand in the way.

Costs can be reduced in a similar way if once again groups of pistons 25 and 27 can be operated by one dimensioning wedge and electric motor assembly.

The foregoing relates to the preferred exemplary embodiments of the invention, it being understood that other variants and embodiments thereof are possible within the spirit and scope of the invention, the latter being defined by the appended claims.

What is claimed is:

1. A fuel injection system for an internal combustion engine, comprising a high-pressure pump (1) for pumping the fuel into a dual-substance nozzle (3), and with a pumping device for pumping a supplementary liquid carried via a check valve (3.4), into a supplementary liquid line (15) leading to the dual-substance nozzle (3), said supplementary liquid line communicates with a pressure chamber (3.5) that surrounds a nozzle needle (3.1) of the dual-substance nozzle (3), a valve assembly for prestoring the supplementary liquid quantity in the dual-substance nozzle (3), in which an opening and closing of the nozzle needle (3.1) are effected by the pressure of a common rail pressure reservoir (2) filled with fuel at high-pressure, the valve assembly is disposed at least partly in the injection line (6) and interrupts the supply of fuel to the injection nozzle (3) in the process of prestoring the supplementary liquid and connects the pressure chamber (3.5) with a low-pressure fuel side, and otherwise interrupts the communication with the low-pressure fuel side and imposes high-pressure fuel on the pressure chamber (3.5), a first 2/2-way valve (MV1) is provided in the injection line (6) between the common rail pressure reservoir (2) and the pressure chamber (3.5) and a second 2/2-way valve (MV2), whose inlet communicates via a feed line (7) with the injection line (6) at a point between the first 2/2-way valve (MV1) and the pressure chamber (3.5), and whose outlet communicates with the low-pressure fuel side via a drain line (8) is provided, the hiah-pressure pump (1) for pumping the fuel is part of a high-pressure pump unit (20), which is capable of accomplishing a quantitative metering for both the fuel injection and the injection of supplementary liquid.

2. The fuel injection system according to claim 1, in which a fill pump (19) is provided, which via a check valve (29.1), which is integrated with the high-pressure pump unit (20), supplies the high-pressure pump unit (20) with fuel at a pressure level of about <10 bar.

3. The fuel injection system according to claim 2, in which the common rail pressure reservoir (2) is supplied with fuel at a pressure level of about >1000 bar by the high-pressure pump unit (20) via an outlet check valve (29.2) that is integrated with the high-pressure pump unit (20).

4. The fuel injection system according to claim 1, in which the common rail pressure reservoir (2) is supplied with fuel at a pressure level of about >1000 bar by the high-pressure pump unit (20) via an outlet check valve (29.2) that is integrated with the high-pressure pump unit (20).

5. The fuel injection system according to claim 1, in which a check valve (9) is provided in the drain line (8) between the second 2/2-way valve (MV2) and the low-pressure fuel side, and a pressure regulating valve (32) is provided in a line between the common rail technology (2) and the low-pressure fuel side.

6. The fuel injection system according to claim 1, in which the high-pressure pump unit (20) includes one or more high-pressure pistons (22) which can compress fuel, counter to the pressure of compression springs (23), to a pressure level of about >1000 bar in a compression chamber (24) in the high-pressure pump unit (29).

7. The fuel injection system according to claim 6, in which the high-pressure pistons (22) are disposed in line and are driven by a camshaft (21).

8. The fuel injection system according to claim 6, in which a longitudinally movable, gap- sealed first piston (25) is disposed on one end of the compression chamber (24), laterally outside a path of reciprocation of the high-pressure pistons (22), and is braced apart by means of a compression spring (26) from a likewise longitudinally movable, gap-sealed second piston (27).

9. The fuel injection system according to claim 7, in which a longitudinally movable, gap-sealed first piston (25) is disposed on one end of the compression chamber (24), laterally outside a path of reciprocation of the high-pressure pistons (22), and is braced apart by means of a compression spring (26) from a likewise longitudinally movable, gap-sealed second piston (27).

10. The fuel injection system according to claim 8, in which the face of the backside of the second piston (27), remote from the first piston (25) is rounded or beveled, and that a longitudinally displaceable dimensioning wedge (28) rests in force-locking fashion on the backside of the second piston (27) and longitudinally arrests the second piston in a variable relative axial position with respect to the first piston (25).

11. The fuel injection system according to claim 9, in which the face of the backside of the second piston (27), remote from the first piston (25) is rounded or beveled, and that a longitudinally displaceable dimensioning wedge (28) rests in force-locking fashion on the backside of the second piston (27) and longitudinally arrests the second piston in a variable relative axial position with respect to the first piston (25).

12. The fuel injection system according to claim 10, in which a electronically triggerable electric motor (30) is provided, which can drive a spindle that engages a thread of the dimensioning wedge (28) and upon rotation is capable of displacing the wedge in a longitudinal direction.

13. The fuel injection system according to claim 1, in which a divider piston unit (40) is provided, which has two inner chambers (41, 42), sealingly separated from one another, of which one chamber (41) can be charged with fuel by the high-pressure pump unit (20) via a hydraulic line (31), and the other chamber (42) can be charged with supplementary liquid from a supply container (45) and as a result of the charging of one inner chamber (41) with fuel, the volume of the other inner chamber (42) can be decreased, and as a result a defined quantity of supplementary liquid can be output to the supplementary liquid line (15) leading to the dual-substance nozzle (3).

14. The fuel injection system according to claim 13, in which the divider piston unit (40) has a diaphragm (43), which is fastened firmly in the divider piston unit (40) and sealingly partitions off a first inner chamber (41) having fuel from a second inner chamber (42) having supplementary liquid.

15. The fuel injection system according to claim 14, in which on a side of the second inner chamber (42), charged with supplementary liquid, opposite the diaphragm (43), a mechanical stop (44) protrudes toward the diaphragm (43).

16. The fuel injection system according to claim 13, in which a relief line (33) leading to a fuel tank (34) branches off from the hydraulic line (31) and includes an overpressure check valve (29.4) which is integrated with the high-pressure pump unit (20).

17. The fuel injection system according to claim 13, in which the second inner chamber (42) of the divider piston unit (40) is charged with supplementary liquid by a fill pump (46) via a check valve (47).

18. A method for operating a fuel injection system as defined by claim 8, in which one entire group of dual-substance nozzles (3) is charged with fuel and supplementary liquid by one high-pressure piston (22) and the first piston (25) and second piston (27) connected to it.

19. The method for operating a fuel injection system according to claim 12, in which one entire group of first pistons (25) and associated second pistons (27) is operated by one electric motor (30), one spindle, and one dimensioning wedge (28).

* * * * *

UNITED STATES PATENT AND TRADEMARK OFFICE

CERTIFICATE OF CORRECTION

PATENT NO. : 6,223,734 B1
DATED : May 1, 2001
INVENTOR(S) : Manfred Ruoff et al.

It is certified that error appears in the above-identified patent and that said Letters Patent is hereby corrected as shown below:

Title page,
Item [22], the PCT filling date should read as follows:

-- (22) PCT Filed: July 6, 1998 --

Signed and Sealed this

Eighth Day of July, 2003

JAMES E. ROGAN
*Director of the United States Patent and Trademark Office*